US005301642A

United States Patent [19]

Matsushiro et al.

[11] Patent Number: 5,301,642

[45] Date of Patent: Apr. 12, 1994

[54] WARMING-UP PROMOTING APPARATUS OF INTERNAL COMBUSTION ENGINE

[75] Inventors: Ryuichi Matsushiro, Okazaki; Toshihiko Igashira, Toyokawa; Shigeo Sasao, Nishio; Masae Oohori, Toyota, all of Japan

[73] Assignees: Nippon Soken, Inc., Nishio; Toyota Jidosha Kabushiki Kaisha, Toyota, both of Japan

[21] Appl. No.: 84,953

[22] Filed: Jul. 2, 1993

[30] Foreign Application Priority Data

Jul. 6, 1992 [JP] Japan ..... 4-178500

[51] Int. Cl.[5] ..... F02F 7/00; F02N 17/02

[52] U.S. Cl. ..... 123/196 AB; 123/195 C; 123/142.5 R; 184/6.22; 184/106

[58] Field of Search ..... 123/196 AB, 195 C, 142.5 R; 184/6.22, 106

[56] References Cited

U.S. PATENT DOCUMENTS

| | | | |
|---|---|---|---|
| 4,134,380 | 1/1979 | Niwa et al. | 123/142.5 R |
| 4,258,679 | 3/1981 | Leitermann | 123/196 AB |
| 4,296,716 | 10/1981 | Hofbauer et al. | 123/196 AB |
| 4,616,609 | 10/1986 | Munch et al. | 123/196 AB |

FOREIGN PATENT DOCUMENTS

| | | | |
|---|---|---|---|
| 3318460 | 11/1984 | Fed. Rep. of Germany | 184/6.22 |
| 49-148332 | 12/1974 | Japan . | |
| 52-30535 | 3/1977 | Japan . | |
| 53-65536 | 6/1978 | Japan . | |
| 0054617 | 4/1980 | Japan | 123/196 AB |
| 0054618 | 4/1980 | Japan | 123/196 AB |
| 0024409 | 2/1982 | Japan | 123/196 AB |
| 58-63309 | 4/1983 | Japan . | |

*Primary Examiner*—E. Rollins Cross
*Assistant Examiner*—Erick Solis
*Attorney, Agent, or Firm*—Cushman, Darby & Cushman

[57] ABSTRACT

An oil pan is provided with a partition member so as to be divided into a main chamber and an antechamber. A vertical wall of the partition member is provided at a lower region thereof with first holes adjacent to an opening of a draft tube of an oil pump and at an upper region thereof with second holes in the vicinity of an oil level. In a state of warming up following the starting, since the oil temperature is low and the viscosity of the oil is large, the oil in the antechamber cannot pass through the first holes. Accordingly, only the oil in the main chamber a quantity of which is small is circulated through the engine by the oil pump, thereby warming up the engine quickly. Low temperature oil in the antechamber is interchanged with the oil in the main chamber little by little through the second holes, so that the temperature thereof is raised gradually. When the viscosity of the oil is decreased as rising of the temperature of the oil, the oil in the antechamber is circulated through the engine by the oil pump in due course.

10 Claims, 12 Drawing Sheets

WARMING-UP PROMOTING APPARATUS OF INTERNAL COMBUSTION ENGINE

FIELD OF THE INVENTION AND RELATED ART STATEMENT

The present invention relates to a warming-up promoting apparatus which can quickly raise the temperature of oil (lubricating oil) circulating in an internal combustion engine so as to speed up the warming up when the engine is started.

As an effective method for improving the fuel consumption of an automobile on which an internal combustion engine is mounted, it has been known to promote the rising of the temperature of oil (lubricating oil) during the warming up immediately after the starting of the engine so as to reduce the mechanical friction loss. According to this method, the amount of oil circulating in the engine is limited only in a short time after the starting and then the temperature of the small quantity of circulating oil is raised rapidly, thereby reducing the viscosity of oil while enhancing the lubricating performance thereof. As a result, the fuel consumption performance is improved correspondingly to the reduction of the friction loss of the engine, and the wear of the sliding portions of the engine is reduced. After the small amount of oil circulating reaches a specified temperature, the remaining oil is allowed to start circulating. In this way, an operation is shifted to a steady condition.

Conventional techniques disclosed in U.S. Pat. No. 4,134,380 and Japanese Utility Model Unexamined Publication No. 58-63309 belong to this method as well.

In the former conventional technique, a part of an oil pan under the oil level is divided into a main chamber and an antechamber by disposing a partition member in the oil pan. The main chamber is provided with an oil strainer having an inlet port through which oil is sucked into an oil pump. The partition member is provided in a lower part of a vertical side wall thereof with a thermostatic valve which is opened when the oil temperature exceeds a specified value and in a part of an upper ceiling thereof with holes. While the oil temperature does not reach the specified value immediately after the starting of an engine, the thermostatic valve is closed to make only the oil in the main chamber circulate in the engine so as to speed up the increase of the oil temperature. When the oil temperature exceeds the specified value, the thermostatic valve of the partition plate is opened to make the antechamber and the main chamber communicate with each other so as to allow the whole quantity of oil to be circulated for lubrication. Examples of this kind of technique are disclosed in Japanese Utility Model Unexamined Publication Nos. 49-148332 and 52-30535.

In the latter conventional technique, an oil pan of an internal combustion engine is provided therein with a partition wall which is substantially identical with the vertical side wall of the partition member used in the former technique and an upper wall which is substantially identical with the upper ceiling of the partition member as well but formed on its top portion with an oil receiving portion serving to receive the oil returned from the engine, so as to form a first oil reservoir chamber corresponding to the main chamber and a second oil reservoir chamber corresponding to the antechamber. The partition wall and the upper wall are provided with first and second thermostatic valves, respectively, which are to be opened when the oil temperature exceeds a specified value. While the oil temperature does not reach the specified value immediately after the starting of the engine, the two thermostatic valves are closed to make only the oil in the first oil reservoir chamber circulate in the engine so as to speed up the increase of the oil temperature. When the oil temperature exceeds the specified value, the two thermostatic valves are opened to make the second oil reservoir chamber and the first oil reservoir chamber communicate with each other so as to allow the whole quantity of oil to be circulated for lubrication.

In either case of the conventional techniques, it is necessary that the partition member in the oil pan is provided with the thermostatic valve which is opened and closed automatically according to the oil temperature, so that not only the structure is complicated but also the provision of thermostatic valve causes the cost to be increased and, at the same time, if the thermostatic valve breaks down to be unopenable, when the operation is shifted to an ordinary operation, the amount of oil for circulation becomes insufficient so that there arises a possibility that the temperature of oil is risen abnormally to make the engine overheat, thus giving rise to problems in terms of cost and reliability. Further, in case of exchanging the oil, the oil in the antechamber (second oil reservoir chamber) cannot be discharged until the thermostatic valve is opened forcibly by for example hand, resulting in a problem that a trouble some operation is needed.

OBJECT AND SUMMARY OF THE INVENTION

An object of the present invention is to solve the above-described problems encountered in the conventional techniques.

To this end, according to the present invention, there is provided a warming-up promoting apparatus of an internal combustion engine comprising: an oil pan in which oil is stored; a partition member disposed in the oil pan of the internal combustion engine and including a substantially vertical wall and a slightly inclined ceiling, the substantially vertical wall serving to divide an interior space of the oil pan into a main chamber and an antechamber, and the slightly inclined ceiling serving to cover the top of the antechamber; an oil pump having a draft tube which is opened in the main chamber at a position adjacent to the bottom thereof, the oil pump for pumping the oil from the oil pan to the engine; a first hole means provided in a lower region of the substantially vertical wall of the partition member in the vicinity of an opening of the draft tube and serving to make the main chamber and the antechamber communicate with each other constantly, an effective area of the first hole means being so small enough to prevent oil from being interchanged between the antechamber and the main chamber through the first hole means when a temperature of oil is low; and a second hole means provided in an upper region of the substantially vertical wall of the partition member below an oil level and serving to make the main chamber and the antechamber communicate with each other constantly, an effective area of the second hole means being so large enough to permit the oil to be interchanged between the antechamber and the main chamber through the second hole means.

BRIEF DESCRIPTION OF THE DRAWINGS

FIG. 1 is a sectional view showing an oil pan used in a first embodiment of the present invention in a state that oil is poured there in;

DETAILED DESCRIPTION OF THE PREFERRED EMBODIMENTS

Figure 1:
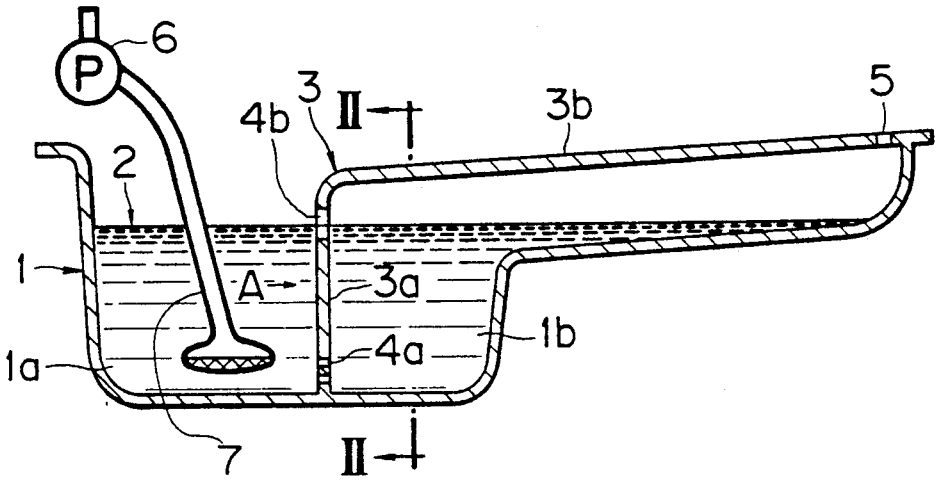

As shown in FIG. 1, an oil pan 1 secured to a bottom of a cylinder block of an internal combustion engine which is not shown, receives and accumulates the oil which falls down by the gravity thereof after lubricating or cooling the engine while it circulates through the engine. An interior space of the oil pan 1 is divided into a main chamber 1*a* and an antechamber 1*b* by means of a partition member 3. The partition member 3 comprises a substantially vertical wall 3*a* and a horizontal ceiling 3*b* slightly inclined and extending from a peripheral edge of the oil pan 1 toward the vertical wall 3*a*. The oil pan 1 and the partition member 3 are formed integrally or separately.

Figure 2:
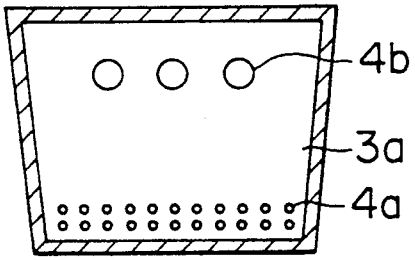
FIG. 2 is a sectional view taken along the line II—II of FIG. 1.

As shown in FIG. 2, a plurality of small holes 4*a* of diameter about 2 mm are formed in a lower part of the vertical wall 3*a*, while a plurality of large holes 4*b* of diameter about 8 mm are formed in an upper part thereof corresponding to an oil level 2. Further, the ceiling 3*b* is provided therein with vents 5.

An oil pump 6 which is driven by the engine directly or indirectly is disposed in the vicinity of the oil pan 1. The oil pump 6 sucks oil from the oil pan 1 and pumps it into the engine to circulate through various portions which are to be lubricated and cooled. A draft tube 7 extending from the oil pump 6 and having a strainer is opened at a portion in the main chamber 1*a* of the oil pan 1 in the vicinity of the bottom thereof.

In case of pouring oil when the engine is stopped, the oil supplied from the top of the engine drops on the ceiling 3*b* of the partition member 3 and flows along the inclination of the ceiling 3*b* so as to be accumulated in the main chamber 1*a* at first. However, the oil may flow into the antechamber 1*b* through the small holes 4*a* and the large holes 4*b*. Since the poured oil at a room temperature has a high viscosity, it is hard to pass through the small holes 4*a*. However, as a level of the oil in the main chamber 1*a* becomes high, the oil is allowed to pass through the large holes 4*b* of low resistance into the antechamber 1*b* smoothly. In this case, air existing in the antechamber 1*b* is exhausted through the vents 5. Therefore, when the pouring of oil is completed, the oil level in the antechamber 1*b* becomes flush with the oil level in the main chamber 1*a*.

As described above, the vents 5 exhaust air to make the oil level in the antechamber 1*b* flush with the oil level in the main chamber 1*a*. Further, the large holes 4*b* promote the flow of oil from the main chamber 1*a* into the antechamber 1*b*, thereby reducing the oil pouring time. Incidentally, these holes also serve to make the oil level in the main chamber 1*a* flush with the oil level in the antechamber 1*b* during the operation of the engine, thereby preventing the air bind.

Figure 3:
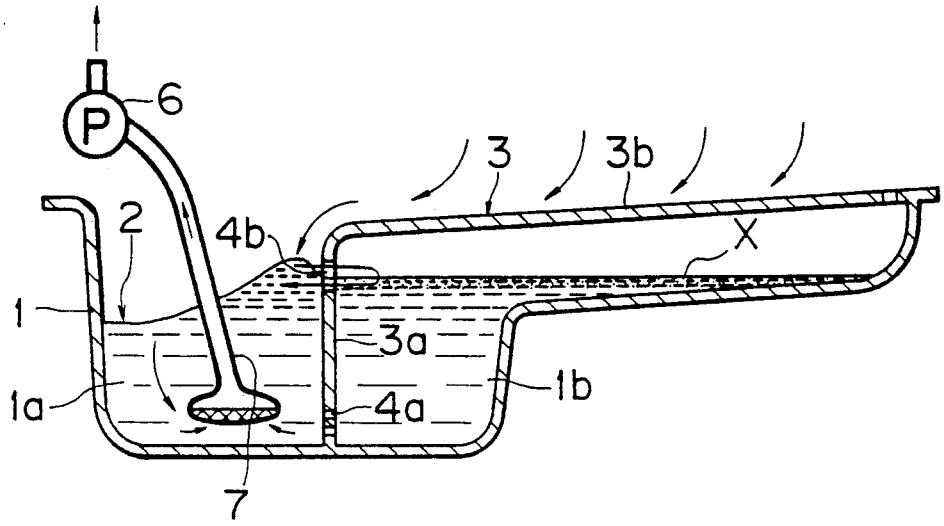
FIG. 3 is a sectional view showing the oil pan of FIG. 1 at the time of starting.

Next, description will be given of the state of operation of the internal combustion engine equipped with the oil pan 1 having the above-described structure. First, as shown in FIG. 3, in a state of the oil level in a warming-up operation following immediately after the starting of the engine, the oil temperature is still low and the viscosity of the oil is high, and then it is hard for the oil to pass through the small holes 4*a*. Therefore, the oil sucked through the draft tube 7 by the action of the oil pump 6 is mostly the oil in the main chamber 1*a*, while the oil in the antechamber 1*b* remains therein as it is and scarcely moves into the main chamber 1*a*. The oil in the main chamber 1*a* is fed into the engine so as to circulate through the portions to be lubricated or cooled and risen in temperature. The oil drops on the ceiling 3*b* of the partition member 3 and returns into the main chamber 1*a* along the inclination of the ceiling 3*b*.

In this way, immediately after the engine is started, only the oil which is pumped out from the main chamber 1*a* of the oil pan 1 and returned again into the main chamber contributes a circulation of oil in the engine, the oil in the antechamber 1*b* hardly moves. The amount of oil present in the main chamber 1*a* is small as compared with the whole amount and hence the heat capacity of the oil in the main chamber 1*a* is small.

Therefore, by making the oil in the main chamber 1*a* circulate alone, the temperature of oil in the main chamber 1*a* is risen rapidly. As a result, the engine can reach the warmed-up state relatively quickly.

Immediately after the engine is started, since the temperature of oil is low and the viscosity thereof is high, the oil accumulated in the antechamber 1*b* of the oil pan 1 can hardly flow into the main chamber 1*a*. However, since the oil in the main chamber 1*a* is ruffled and disturbed due to suction by the oil pump 6 and dropping of the return oil, a part of the oil in the main chamber 1*a* passes through the large holes 4*b* into a relatively narrow range in the antechamber 1*b* as shown by a hatched portion X of FIG. 3 due to an instantaneous difference in water head between the main chamber 1*a* and the antechamber 1*b*. Further, the upper oil in the antechamber 1*b* is partially passes through the large holes 4*b* as well. Since the temperature of the oil in the main chamber 1*a* is rising, such interchange of small amount of oil between the both chambers rise the temperature of oil in the antechamber 1*b* gradually.

As apparent from the above, since a heat transfer occurred in the antechamber 1*b* is mainly a heat diffusion from an upper layer to a lower layer, and not a heat convection, the heat diffusion and the general temperature rise in the antechamber 1*b* is progressed extremely gradually as compared with those in the main chamber 1*a*. Therefore, since the oil in main chamber 1*a* receives almost heat from the engine, the temperature of the oil in the main chamber rises rapidly and remarkably, thereby promoting the warming up of the engine.

At the same time that the engine reaches the warmed-up state owing to the oil in the main chamber 1*a*, the temperature of oil in the antechamber 1*b* is also risen gradually though it is gentle, and the viscosity thereof is lowered gradually as described before. Therefore, the oil in the antechamber 1*b* becomes to readily pass through the small holes 4*a*, so that the suction force of the oil pump 6 can affect the oil in the antechamber 1*b* through the small holes 4*a*. Accordingly the oil in the antechamber 1*b* the temperature of which is relatively low is also sucked by the oil pump 6 little by little, together with the oil in the main chamber 1*a* and then circulated in the engine. As a result, the upper part oil in the main chamber 1*a* is caused to flow into the antechamber 1*b* through the large holes 4*b* by an amount equal to the amount of oil sucked through the small holes 4*a*, thereby increasing the temperature of oil in the antechamber 1*b* rapidly.

Figure 4:
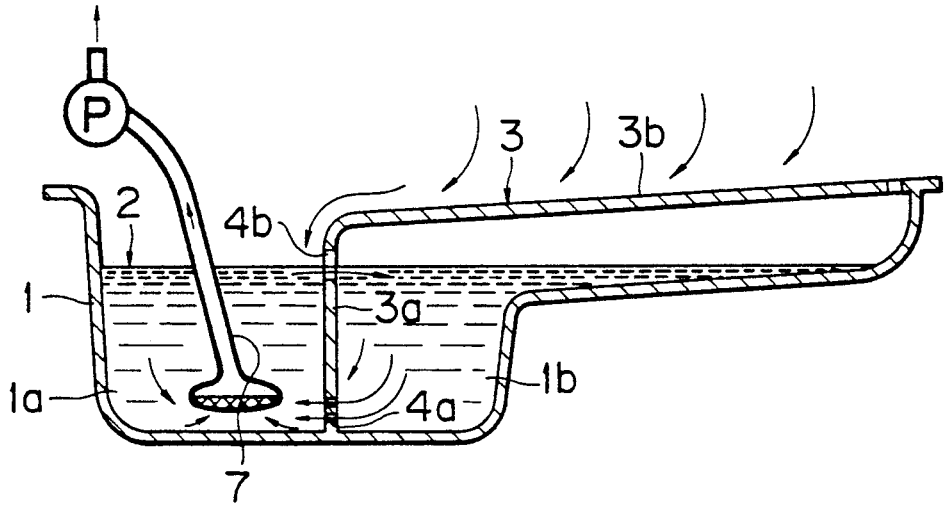
FIG. 4 is a sectional view showing the oil pan of FIG. 1 during the steady operation.

After the temperature of oil in the antechamber 1*b* is risen sufficiently, since the viscosity of oil in the chambers becomes sufficiently small, regardless of the partition member 3, the oil in the chambers 1*a* and 1*b* are readily or freely interchanged with each other through the holes 4*a* and 4*b* as shown in FIG. 4. Therefore the whole oil in the oil pan 1 including the oil in the antechamber 1*b* circulates in the engine and then a difference in the oil temperature between the main chamber 1*a* and the antechamber 1*b* becomes small. This state is the steady operation condition of the engine.

After the engine is warmed up, such extended circulation of oil prevents that only the oil in the main chamber 1*a* is overheated to become worse rapidly. Accordingly, it is unnecessary to replace the oil frequently as in the conventional engine in which no partition member is provided. In the engine to which the above embodiment is applied, since the engine is warmed up quickly, the fuel consumption during the warming-up is improved as well as the durability of the engine is improved because wear in the mechanical friction portions is reduced.

Figure 5:
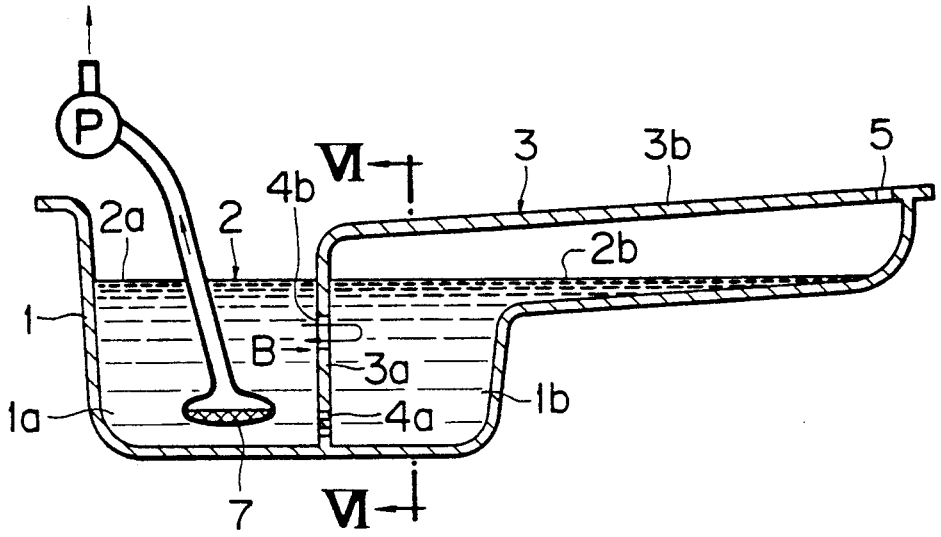
FIG. 5 is a sectional view showing a modification of the first embodiment of the present invention.
Figure 6:
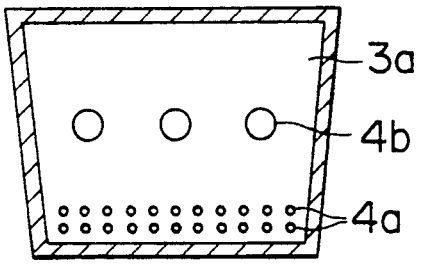
FIG. 6 is a sectional view taken along the line VI—VI of FIG. 5.

In the modification shown in FIG. 5, the small holes 4*a* formed in the lower part of the vertical wall 3*a* of the partition member 3 are the same as those shown in FIG. 2, but the large holes 4*b* are different in the position thereof from those shown in FIG. 2. They are positioned below the oil level 2 as shown in FIG. 6. Such state may appear as well if much oil is poured in the first embodiment.

In this case, substantially like the case of the first embodiment, the temperature of oil in the main chamber 1*a* is risen rapidly in the beginning. When the oil in the main chamber 1*a* is sucked by the oil pump 6, the oil in the main chamber 1*a* is ruffled and disturbed, so that the oil in the main chamber 1*a* and the oil in the antechamber 1*b* are interchanged with each other little by little through the large holes 4*b*. Thus the temperature of oil in the antechamber 1*b* is gradually risen from top to bottom. After the time is elapsed considerably, the temperature of oil in the antechamber 1*b* near the small holes 4*a* becomes high and hence the viscosity of the oil is lowered. Therefore, the amount of oil sucked by the oil pump 6 from the antechamber 1*b* to the main chamber 1*a* through the small holes 4*a* is increased so that a whole oil in the oil pan 1 circulates through the engine, resulting in that substantially the same effects as those of the first embodiment can be obtained.

The embodiments of FIGS. 1 and 5 offer the substantially same advantages. Therefore, it is apparent that the large holes 4*b* need not to be positioned close to the oil level 2, but may be lower than that.

Next, description will be given of the results of investigation made about the arrangement and the dimensions of the small holes 4*a* and the large holes 4*b* through the systematic experiments with referring to FIG. 8.

FIGS. 7A–7D show the configuration of the vertical walls 3*a* of four kinds of partition members 3 used in the experiments in which the positions, the numbers, and the diameters of the holes 4*a* and 4*b* are changed. Though the holes 4*a* and 4*b* used in the experiments are circular, they may be square, triangle, oval or a slit like opening.

The experiments are conducted with regard to five kinds of oil pans including a one oil pan without the partition member and four oil pans with the partitions shown in FIG. 7A–7D. The changes of the oil temperature are measured with regard to the respective oil pans and are shown in FIG. 8. The experiments are conducted with an automobile gasoline engine of a displacement of 2200 cc under the operational condition that the engine is started at a starting point at time 0 on the abscissa, and immediately thereafter, the rotational speed is set at 1400 rpm and the load torque is set at 1.5 kgm, and then these conditions are maintained. The oil pans with no partition member and with a partition member having no holes are employed as references. The results thereof are marked by Δ (broken line E) and O (solid line A), respectively. Incidentally, the capacity of the oil pan 1 is 3.6 liters which is divided into 2 liters for the main chamber 1*a* and 1.6 liters for the antechamber 1*b*.

Figure 8:
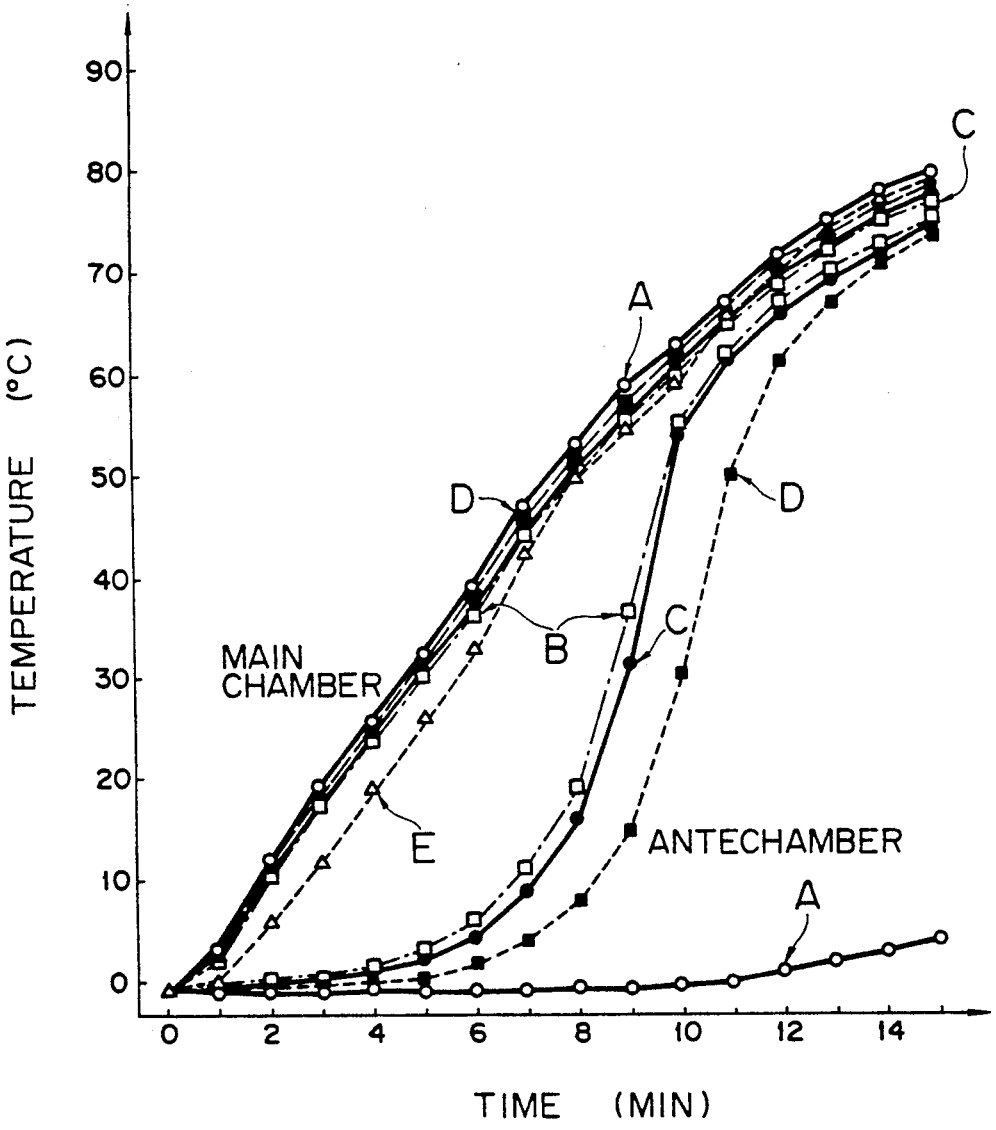
FIG. 8 is a graph showing the change of the oil temperature at the time of warming up the engine with respect to the time elapsed, in regard to engines in which the partition members of FIGS. 7A to 7D are used and an engine in current use in which no partition member is used.

As seen from FIG. 8, in the engine with the oil pan with partition member 3 having no holes, as indicated by the solid line A, since the oil in the main chamber 1*a* is exclusively circulated through the engine at first, the oil temperature in the main chamber 1a rises quick. On the other hand, the temperature of the oil in the antechamber 1b is hardly risen and the oil in the antechamber 1b isn't used for lubrication of the engine.

To the contrary, in the cases of the engines with the oil pans with partition members having holes, as indicated by the one-dot line B, the solid line C and the broken line D, respectively, the oil temperature in the antechamber 1b is risen very gradually at first, as compared with the oil temperature in the main chamber 1a. After a certain time elapsed, it rises up extremely to approach the oil temperature in the main chamber 1a. It is considered that such extreme rise in the oil temperature in the antechamber 1b is caused by the function and the mechanism described above. Namely, when the viscosity of the oil in the antechamber 1a is lowered blow a critical level as the oil gradually rises the temperature thereof the amount of oil sucked from the antechamber 1b into the draft tube 7 of the oil pump 6 is increased rapidly, so that the oil in the main chamber 1a and the antechamber 1b is interchanged with each other actively, with the result that a large quantity of high temperature oil in the main chamber 1a flows into the antechamber 1b to rise the oil temperature in the antechamber 1b rapidly.

Figure 7A:
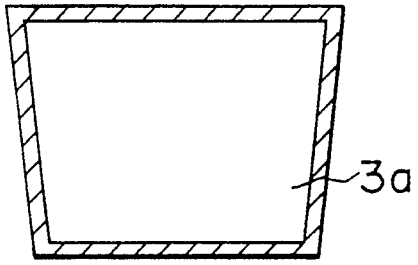
FIGS. 7A to 7D are sectional views showing the configuration of vertical walls of partition members used for experiments, respectively.
Figure 7B:
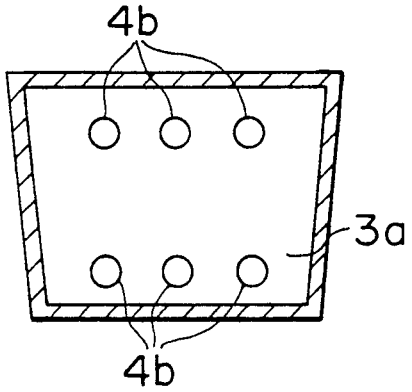
Figure 7C:
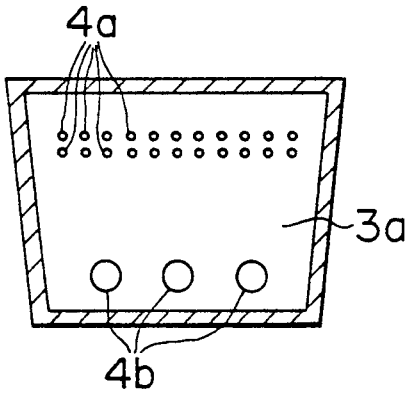
Figure 7D:
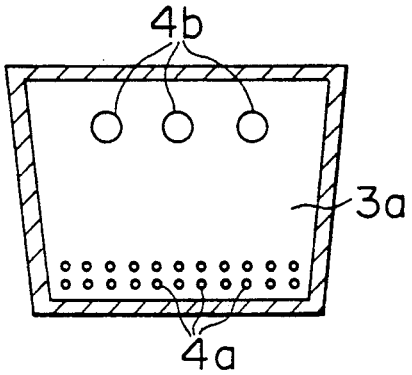

In case of using the partition member 3 shown in FIG. 7D, the oil temperature in the antechamber 1b indicated by the solid line D begins to rise lastly like the first embodiment shown in FIG. 1. Therefore, the rising of the oil temperature in the main chamber 1a of the oil pan 1 using the vertical wall 3a shown in FIG. 7D becomes closest to that in the main chamber 1a of the oil pan 1 using the vertical wall 3a shown in FIG. 7A. Further, after thirteen minutes have elapsed or after the warming-up has proceeded considerably, the oil temperature becomes substantially equal to that of the case of the oil pan with no partition member indicated by the broken line E. Accordingly, there is no possibility that the engine is overheated even in a high speed and high load operation.

On the other hand, in the cases of using the partition members shown in FIGS. 7B and 7C, the risings of the oil temperature in the antechamber 1b indicated by the one-dot line B and the solid line C are earlier than in the case of using the partition member shown in FIG. 7D indicated by the broken line D, while the risings of the oil temperature in the main chamber 1a indicated by the one-dot line B and the solid line C become later correspondingly as compared with the case of using the partition member shown in FIG. 7D indicated by the broken line D. Moreover, after eleven minutes have elapsed, the oil temperature is less than that obtained in the case of no partition member. As a result, it is possible to say that the partition member of FIG. 7D is the best among the partition members shown in FIGS. 7A–7D. However, even in case of using the partition member shown in FIG. 7B or FIG. 7C, the oil temperature can be made higher as compared with the oil pan without partition member during the oil temperature is low, which has great effects on the fuel consumption, and therefore, the partition members of FIGS. 7B and 7C are worth using from the view point of the reduction of the fuel consumption.

Taking into the consideration the facts that the most excellent result is obtained in the case of using the partition member of FIG. 7D and that substantially the same results are obtained in the cases of using the partition members of FIGS. 7B and 7C, it is proved that in the oil pan provided with the partition member 3 having the small holes 4a and the large holes 4b, the characteristics of the oil temperature change are determined by the holes provided adjacent to the opening of the draft tube 7 of the oil pump 6. Namely, it is proved that if the holes in the lower part of the vertical wall 3a of the partition member 3 in the vicinity of the opening of the draft tube 7 of the oil pump 6 are small ones, the change of the viscosity of oil in the antechamber 1b varies the passage resistance of the small holes 4a considerably, so that the small holes 4a can perform as the valve.

Accordingly, the timing of the rising of the oil temperature in the antechamber 1b can be controlled (advanced or delayed) to a certain extent in accordance with the size and the numbers of the holes formed in the lower part of the vertical wall 3a of the partition member 3. However, if the timing of the rising of the oil temperature in the antechamber 1b is advanced, the effect of reducing the fuel consumption may be decreased, while it is too delayed, there is a possibility that the engine is overheated at the high speed and high load operation. Further, since the speed of interchange between the oil in the antechamber 1b and the oil in the main chamber 1a is slowed down, the deterioration of the oil is accelerated inevitably. For the reasons described above, the size and the number of the holes formed in the lower part of the vertical wall 3a of the partition member 3 are limited, but it is desired in general that the diameter of the hole is not less than 2 mm since it is necessary to prevent the hole from being closed by the foreign matter.

In case of the partition member shown in FIG. 7D, in which twenty small holes 4a of diameter 2 mm are formed, a total (effective) opening area S is obtained in accordance with the following expression:

$$S=\pi d^2\times N\div 4$$

where d represents the diameter of the hole and N represents the number of the holes.

Accordingly, the total (effective) opening area S is:

$$S=20\pi\approx 62.8\ \mathrm{mm}^2$$

This total (effective) opening area S is an important value which determines the circulation speed of the oil in the antechamber 1b. In this case, an actual circulation speed of the oil is about 3.3 cc/sec.

In this experiment, since the amount of oil in the antechamber 1b is 1.6 liters, the interchanging time required for the oil in the antechamber 1b to be all interchanged is about 8 minutes as a result of the following calculation:

$$1600\div 3.3\approx 485\ sec.\approx 8\ min.$$

If the interchanging time is allowed to be extended to 30 minutes for 1.6 liters, the circulation speed can be reduced to:

$$3.3\div 30\times 8=0.88\ cc/sec.$$

Further, the total (effective) opening area S at this time can be decreased to:

$$62.8\div 30\times 8\approx 16.7\ mm^2.$$

This value means that at least six holes are needed when the diameter thereof is 2 mm.

To the contrary, in the case of the partition member 3 shown in FIG. 7B, the total (effective) opening area S is:

$$S=\pi\div4\times8^2\times3=150.8\ \text{mm}^2.$$

If this value is set as an upper limit of the total (effective) opening area, forty-eight holes of diameter 2 mm are needed.

Accordingly, the number N of the holes formed in the lower part of the vertical wall 3*a* of the partition member 3 is preferably within the following range when the diameter thereof is 2 mm:

$$6\leqq N\leqq48 \quad (1)$$

Further, when the diameter of the hole is selected arbitrarily, it is preferable that the total (effective) opening area S is set to be in the following range:

$$16.7\ mm^2\leqq S\leqq150.8\ mm^2 \quad (2)$$

Incidentally, in case that the diameter of the holes formed in the lower part of the vertical wall 3*a* of the partition member 3 is not less than 13.8 mm, the total (effective) opening area exceeds the upper limit of 150.8 $mm^2$ even if the number of such hole is one, and therefore, the diameter d of the hole is in the following range:

$$2\ mm\leqq d\leqq13.8\ \text{mm}.$$

The holes formed in the upper part of the vertical wall 3*a* of the partition member 3 can fulfill their functions sufficiently as shown in FIG. 8 even if they are the ones shown in FIG. 7C. The opening area S′ of the holes in the upper part of the vertical wall 3*a* shown in FIG. 7C is:

$$S'=\pi\div4\times2^2\times20\simeq62.8\ mm^2.$$

Since it is considered to be all right provided that the opening area S′ exceeds this value, the diameter and the number of the holes may be freely selected so as to satisfy the following condition:

$$S'\geqq62.8\ \text{mm}^2 \quad (3)$$

Further, the configuration of the hole is not limited to the circular shape but may be any desired shape as described before, under the condition that the expressions (2) and (3) are satisfied.

In addition, the small holes 4*a* and the large holes 4*b* in the vertical wall 3*a* of the partition member 3 are shown as being formed by punching out the partition member 3 made of a sheet material, but they may be replaced by inserting short pipes through the vertical wall 3*a* and the pipes may be inclined more or less. However, the angle of inclination must be not more than 45° with respect to the oil level 2.

Figure 9:
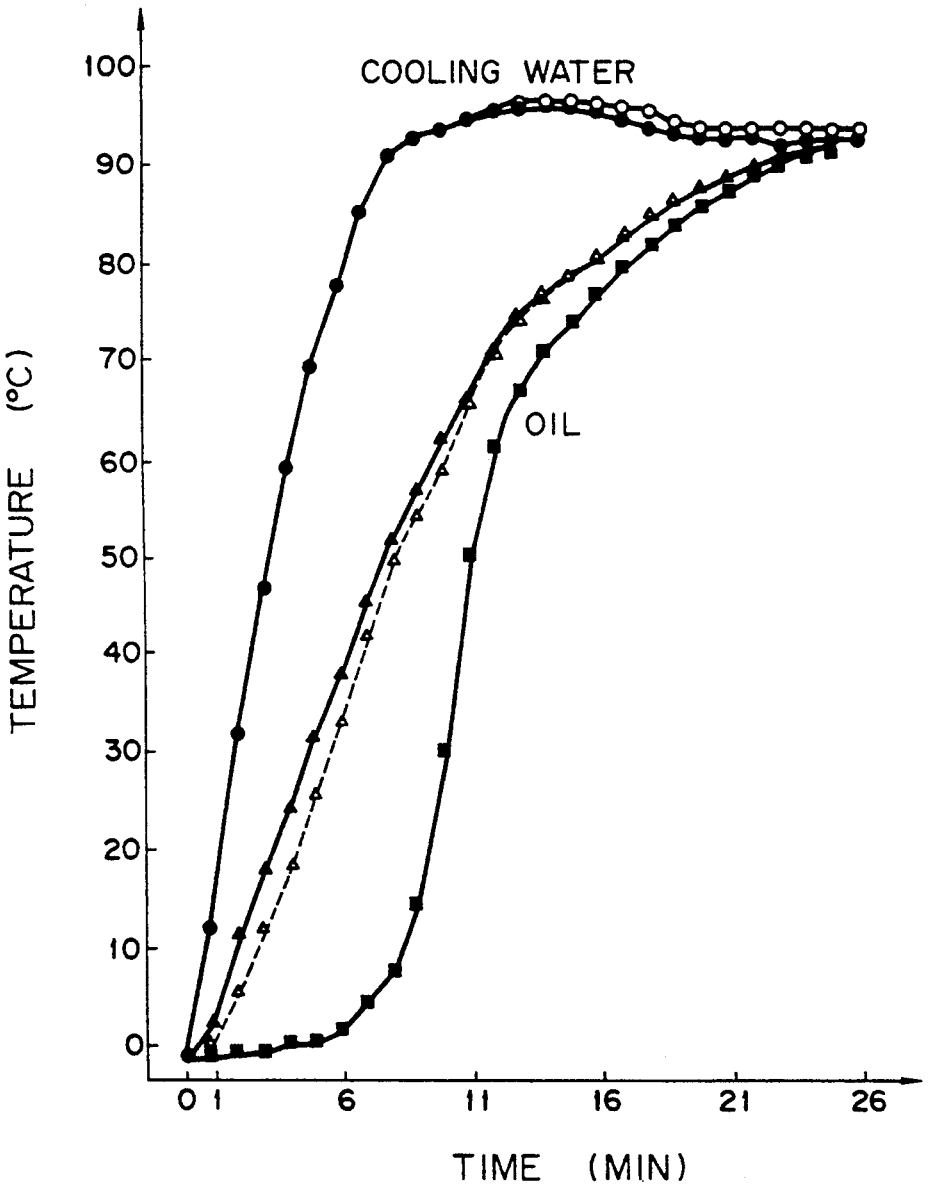
FIG. 9 is a graph showing the changes of the oil temperature and of the cooling water temperature with respect to the time elapsed, in regard to an engine in which the partition member of the first embodiment of the present invention is used and an engine in which no partition member is used, respectively.
Figure 10:
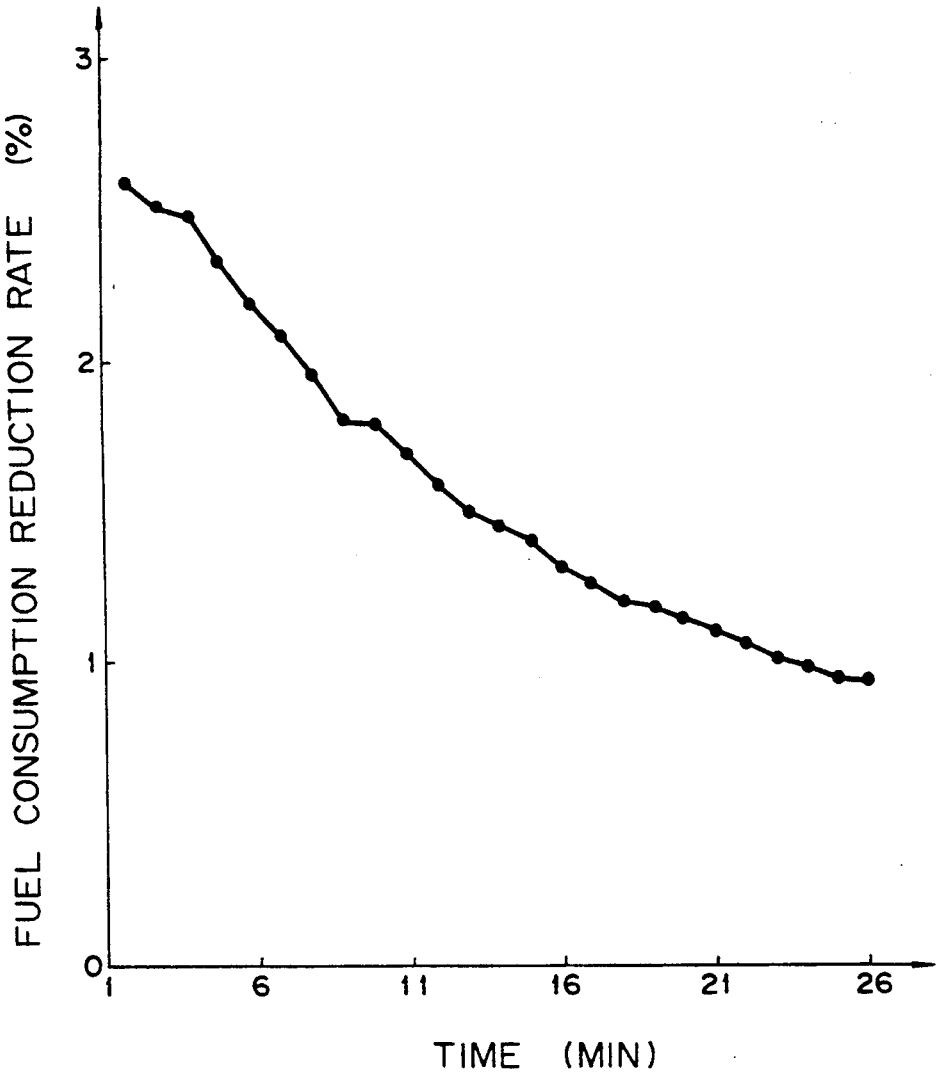
FIG. 10 is a graph showing the change of the fuel consumption reduction rate with respect to the time elapsed, in regard to an engine in which the first embodiment of the present invention is applied.

FIGS. 9 and 10 show the changes of the oil temperature and of the cooling water temperature with respect to the time elapsed and the change of the fuel consumption reduction rate with respect to the time elapsed, in connection with the oil pan using the partition member 3 of FIG. 7D and the oil pan using no partition member. The fuel consumption is reduced most greatly immediately after the engine is started. As the oil temperature (▲) in the main chamber 1*a* approaches the oil temperature (Δ) in the oil pan without partition member, the fuel consumption reduction rate is reduced as well. Incidentally, the fuel consumption reduction rate shown in FIG. 10 is computed in such a manner that the fuel consumption is summed up and recorded every minute from the starting to a desired point of time and the thus recorded values are compared with those of the oil pan using no partition member to determine the fuel consumption reduction rate. There is no substantial difference in the cooling water temperature (●, ○) between the above two cases. The oil temperature (■) in the antechamber 1*b* is risen later.

In the above experiments, the total amount of oil in the oil pan 1, that is, 3.6 liters is divided into 2 liters for the main chamber 1*a* and 1.6 liters for the antechamber 1*b* as mentioned before. However, even if this division ratio is changed to some extent, the rising characteristic of the oil temperature shown in FIG. 9 and the fuel consumption reduction rate shown in FIG. 10 are not changed so much.

In the present invention, the "upper" and the "lower" parts of the vertical wall 3*a* of the partition member 3, in which the holes are provided should be defined with respect to a centre line which divides equally the vertical wall 3*a* in a height direction. Accordingly, even in the case that the vertical wall 3*a* is for example in a mesh structure in which small holes of diameter 2 mm are distributed over a whole of the wall, such vertical wall 3*a* is considered to be in a scope of the present invention if the expressions (2) and (3) are satisfied.

Figure 11:
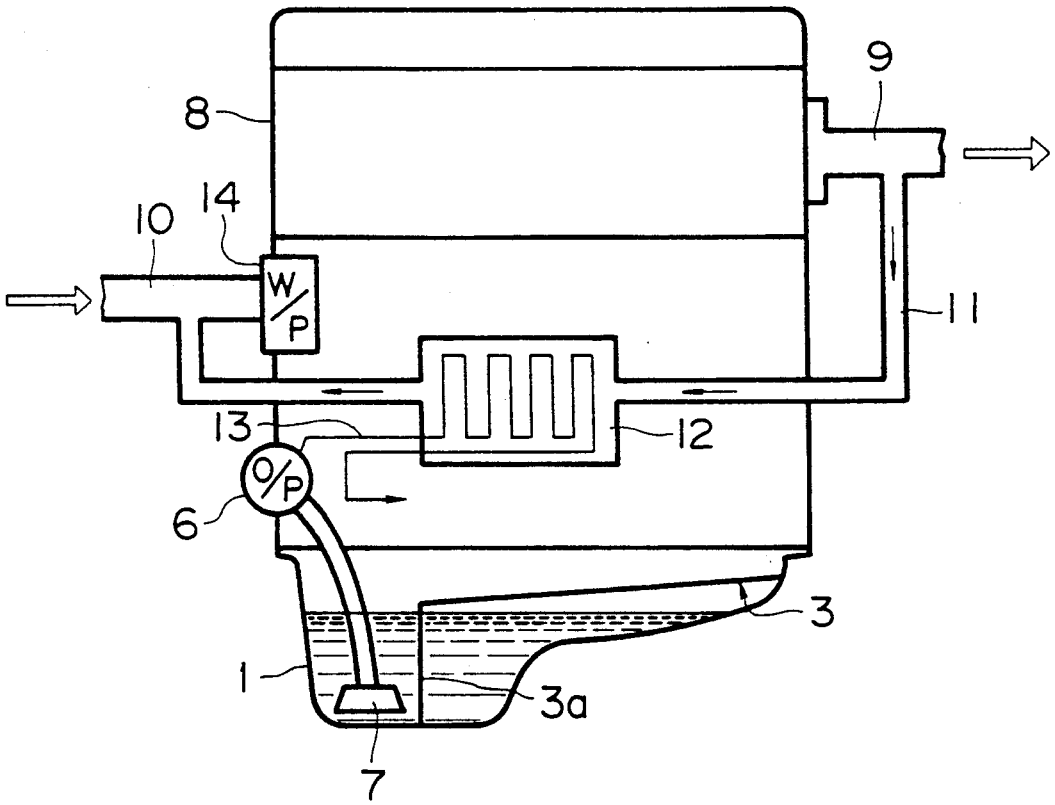
FIG. 11 is a schematic view showing a construction of a second embodiment of the present invention.

In the second embodiment shown in FIG. 11, in addition to the provision of the same partition member 3 as of FIG. 1 in the oil pan 1, a heat exchanger is provided in order to further promote the warming up of the engine, thereby more reducing the fuel consumption. In the heat exchanger, the oil is additionally heated by the cooling water which is risen in the temperature by cooling the engine, so as to hasten the warming up of the engine.

More specifically, a heat exchanger 12 is disposed in a bypass passage 11 connecting a cooling water outlet 9 equipped to the engine 8 and communicated with a radiator (not shown) with a cooling water inlet 10 through which the cooling water returned from the radiator passes.

Further, the oil pump 6 which sucks the oil from the main chamber 1*a* of the oil pan 1 having the partition member 3 and pumps it is connected to the main gallery in the engine 8 through an oil passage 13 passing through the heat exchanger 12, thereby heating the oil supplied to the engine with the cooling water circulated by a cooling water pump 14.

Figure 12:
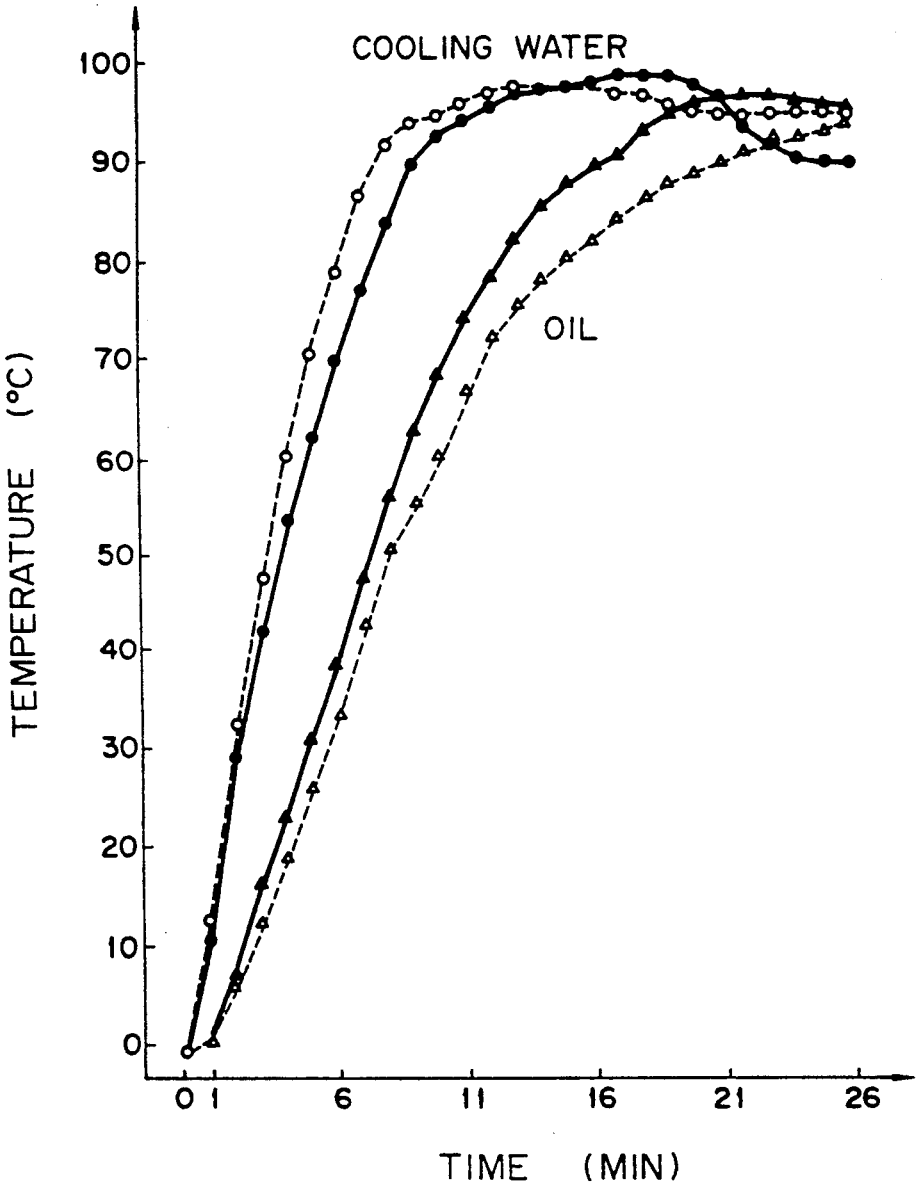
FIG. 12 is a graph showing the changes of the oil temperature and of the cooling water temperature with respect to the time elapsed, in regard to an engine which has only a heat exchanger and an engine in current use, respectively.
Figure 13:
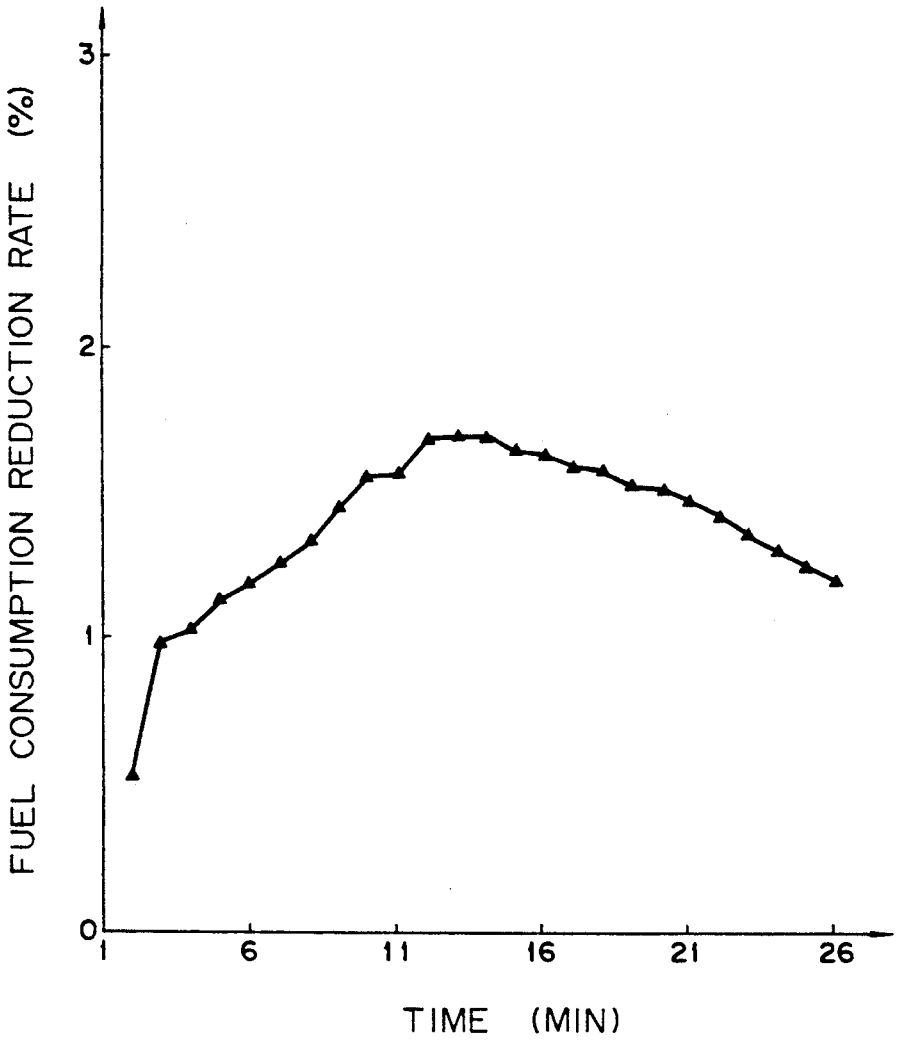
FIG. 13 is a graph showing the change of the fuel consumption reduction rate with respect to the time elapsed, in regard to an engine having only the heat exchanger.

In order to confirm the effects of the heat exchanger 12 and the partition member 3 in the second embodiment, experiments are made on the engine having a heat exchanger and an oil pan without a partition member 3 and on the engine having no heat exchanger and an oil pan without a partition. The changes of the oil temperature and the cooling water temperature with respect to the time elapsed, and the change of the fuel consumption reduction rate computed by comparing the both with respect to the time elapsed are shown in FIGS. 12 and 13, respectively. It is apparent that in the beginning of the starting of the engine, since the temperature of the cooling water is low, the cooling water has no ability to heat the oil, but in the range where the oil temperature exceeds 60° C., the cooling water remarkably affects the increasing of the oil temperature (Δ), as compared with that (Δ) of the engine having no heat exchanger. As is also apparent from FIG. 13, the fuel consumption reduction rate is the largest at a point where twelve minutes has been elapsed from the starting of the engine.

Figure 14:
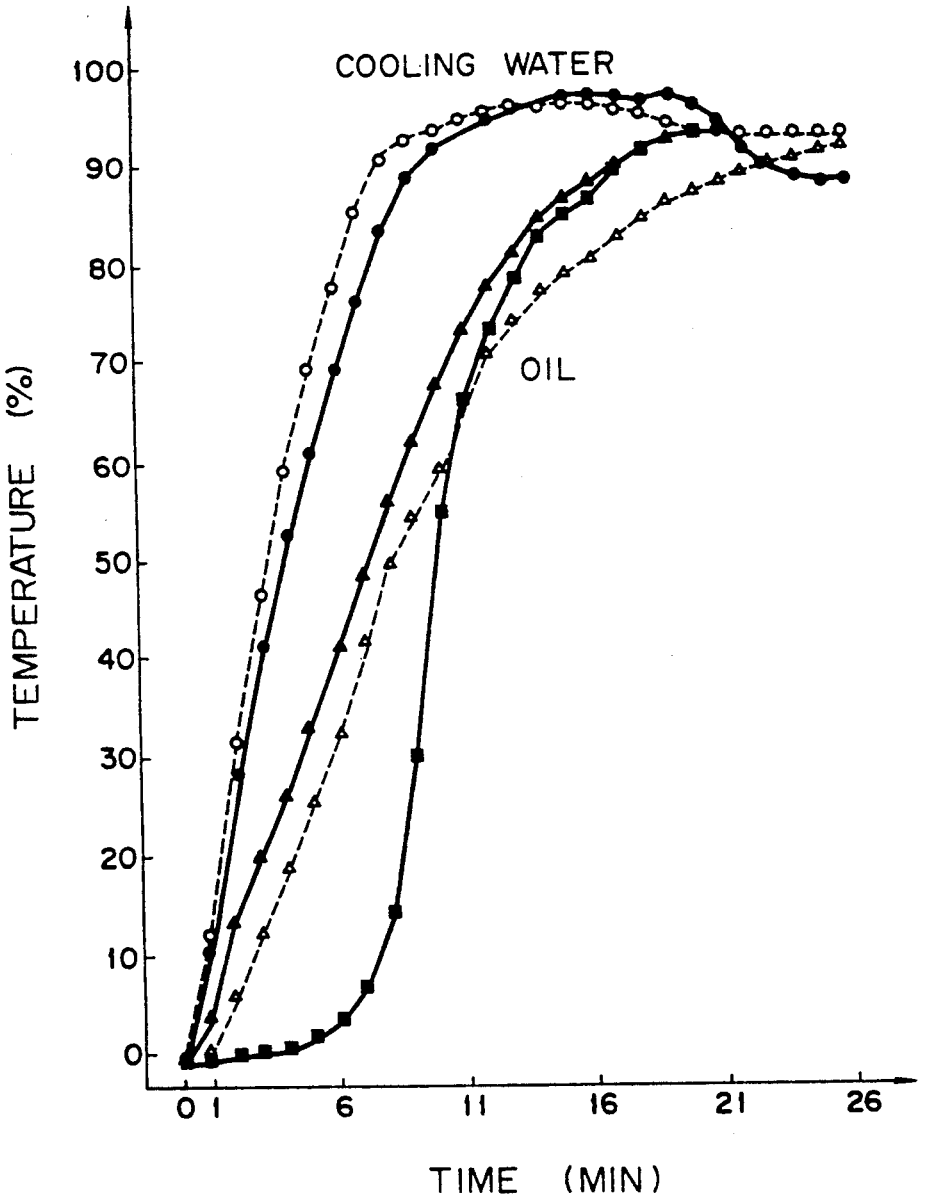
FIG. 14 is a graph showing the changes of the oil temperature and the cooling water temperature with respect to the time elapsed, in regard to an engine in which the second embodiment of the present invention is applied and an engine in current use.
Figure 15:
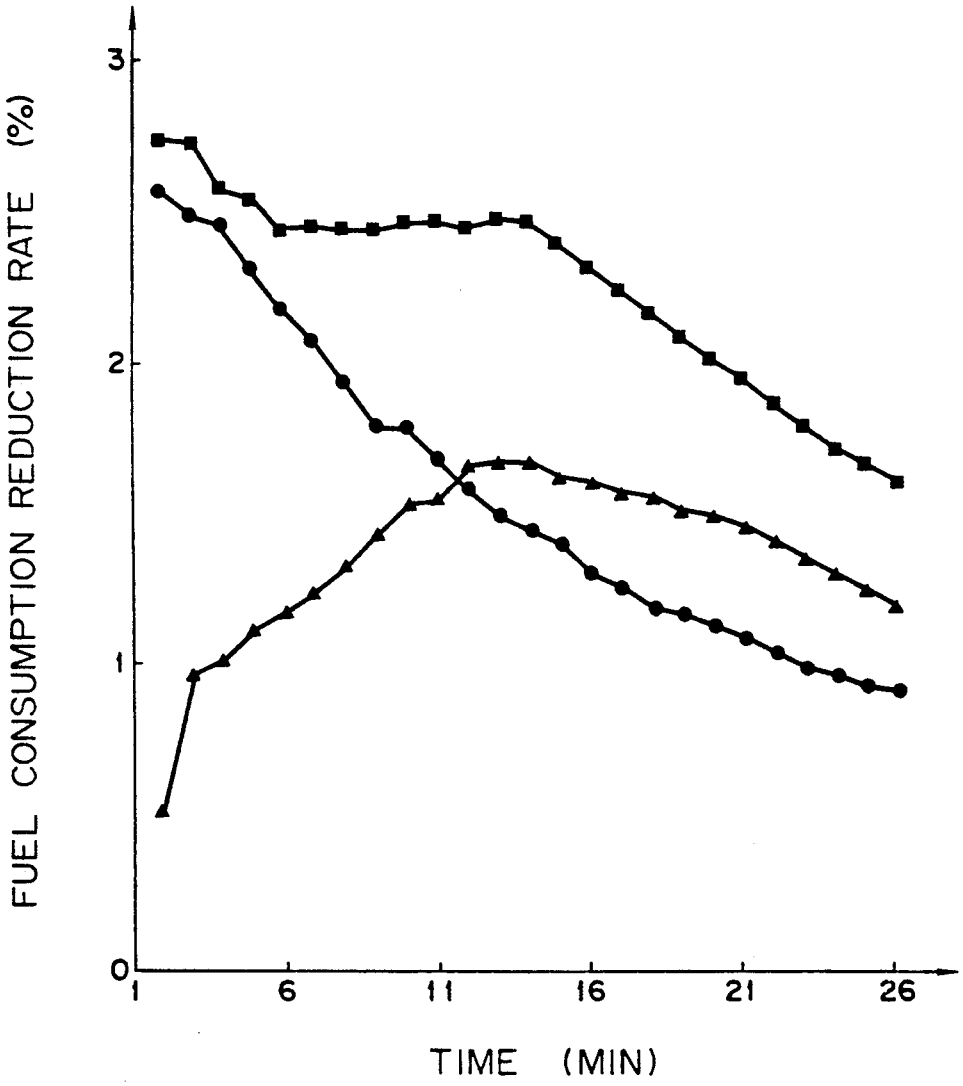
FIG. 15 is a graph showing the change of the fuel consumption reduction rate with respect to the time elapsed, in regard to engines in which the first and second embodiments of the present invention are applied, respectively, and an engine having only the heat exchanger.

The changes of the oil temperature and the cooling water temperature with respect to the time elapsed are shown in FIG. 14, which are obtained through the experiments conducted on the engine 8 shown in FIG. 11 having a heat exchanger and an oil pan with a partition member and the engine having no heat exchanger and an oil pan without the partition member. The changes of the fuel consumption reduction rates with respect to the time elapsed are shown in FIG. 15, which are obtained through the experiments conducted on the engine 8 shown in FIG. 11 having a heat exchanger and an oil pan with a partition member (second embodiment) (■), on the engine having no heat exchanger and an oil pan with a partition member (first embodiment) (●), and on the engine having a heat exchanger and an oil pan without a partition member (Δ), respectively, in compared with the comparative engine having no heat exchanger and an oil pan without a partition member.

Referring to FIG. 14, in connection with the engine 8 shown in FIG. 11, the oil temperature (Δ) in the main chamber 1*a* can be made higher than that (Δ) in the comparative engine throughout the warming up. Further, when the atmospheric temperature is 0° C., the time period required for rising the oil temperature to 20° C. in the engine shown in FIG. 11 can be shortened by seventy-five seconds as compared with the comparative engine. It is apparent from FIGS. 9 and 11 that the engine 8 shown in FIG. 11 has the advantage over the engine having only an oil pan with the partition member, which can shorten the time period required for rising the oil temperature by fifty-four seconds.

The engine 8 having the heat exchanger 12 and the oil pan 1 with the partition member 3 can enjoy the effects of both the partition member 3 and the heat exchanger 12. As shown in FIG. 15, the fuel consumption reduction rate of such engine can be made higher constantly over the whole range from the engine starting to a completion of the warming up, i.e., for twenty-six minutes, as compared with either the engine having no heat exchanger and an oil pan with the partition member (first embodiment) or the engine having a heat exchanger and an oil pan without the partition member. Further, in the second embodiment, by combining the oil pan with the partition member with the heat exchanger, the time period for the operation in which the oil temperature is low and the friction loss is considerable can be shortened, and therefore, the scuffing of the sliding portions of the engine is suppressed to prevent the piston ring, the bearing portions and the like from being worn out. From this point of view as well, it can be considered that the second embodiment shows a multiplied effect which is superior to the effect obtained by adding the individual effects of the partition member and the heat exchanger, with the result that the durability of the internal combustion engine can be greatly improved.

According to the present invention, the time period required for the warming up of the engine can be shortened, thereby making it possible to prevent the deterioration of the fuel consumption during the warming up as well as to suppress the wear of the sliding portions attributable to the mechanical friction so as to improve the durability of the engine.

Moreover, according to the present invention, it is not necessary to use anything like a thermostatic valve or the like which is liable to cause a trouble or become an important factor of the increase of the cost, and therefore, it is possible to reduce a cost with high reliability.

What is claimed is:

1. A warming-up promoting apparatus of an internal combustion engine comprising:

an oil pan in which oil is stored;

a partition member disposed in said oil pan of said internal combustion engine and including a substantially vertical wall and a slightly inclined ceiling, said substantially vertical wall serving to divide an interior space of said oil pan into a main chamber and an antechamber, and said slightly inclined ceiling serving to cover a top of said antechamber;

an oil pump having a draft tube which is opened in said main chamber at a position adjacent to a bottom of said main chamber, said oil pump being for pumping the oil from said oil pan to said engine;

a first hole means provided in a lower region of said substantially vertical wall of said partition member in the vicinity of an opening of said draft tube for making said main chamber and said antechamber communicate with each other constantly, an effective area of said first hole means being small enough to prevent the oil from being interchanged between said antechamber and said main chamber through said first hole means when a temperature of oil is low; and a second hole means provided in an upper region of said substantially vertical wall of said partition member below an oil level and making said main chamber and said antechamber communicate with each other constantly, an effective area of said second hole means being large enough to permit the oil to be interchanged between said antechamber and said main chamber through said second hole means.

2. An apparatus according to claim 1, wherein said apparatus further comprises an oil passage through which the oil is fed into said engine through said oil pump, and a heat exchanger through which said oil passage extends and in which the oil passing through said oil passage is heated by cooling water of said engine.

3. An apparatus according to claim 1, wherein a diameter of said first hole means is in a range of 2 mm to 13.8 mm.

4. An apparatus according to claim 3, wherein a total effective opening area of said first hole means is in a range of 16.7 $mm^2$ to 150.8 $mm^2$.

5. An apparatus according to claim 4, wherein a total effective opening area of said second hole means is not less than 62.8 $mm^2$.

6. An apparatus according to claim 5, wherein said opening area of said second hole means is greater than that of said first hole means.

7. An apparatus according to claim 1, wherein vents are provided in an upper part of said inclined ceiling of said partition member.

8. An apparatus according to claim 2, wherein a diameter of said first hole means is in a range of 2 mm to 13.8 mm.

9. An apparatus according to claim 8, wherein a total effective opening area of said first hole means is in a range of 16.7 $mm^2$ to 150.8 $mm^2$.

10. An apparatus according to claim 9, wherein a total effective opening area of said second hole means is not less than 62.8 $mm^2$.

* * * * *